United States Patent [19]

Hooten

[11] Patent Number: 5,031,723

[45] Date of Patent: Jul. 16, 1991

[54] LADDER ACCESSORIES

[76] Inventor: Jack D. Hooten, 7154 Thatcher, Detroit, Mich. 48210

[21] Appl. No.: 368,820

[22] Filed: Jun. 20, 1989

[51] Int. Cl.[5] ..... E06C 7/00

[52] U.S. Cl. ..... 182/129; 182/120; 248/238; 248/211

[58] Field of Search ..... 182/102, 129, 92, 116, 182/120; 248/210, 211, 236, 238, 200.1, 225.31, 219.1

[56] References Cited

U.S. PATENT DOCUMENTS

| | | | |
|---|---|---|---|
| 1,960,863 | 5/1934 | Boyer | 248/238 |
| 2,585,150 | 2/1952 | McGill | 248/238 X |
| 3,160,383 | 12/1964 | Lamm | 248/211 |
| 3,422,923 | 1/1969 | Lund | 182/129 X |
| 3,822,847 | 7/1974 | Emmons | 248/210 |
| 3,842,936 | 10/1974 | DeLuca | 182/129 |
| 4,660,794 | 4/1987 | Given | 182/129 |

FOREIGN PATENT DOCUMENTS

| | | | |
|---|---|---|---|
| 745837 | 3/1956 | United Kingdom | 182/129 |

*Primary Examiner*—Karen J. Chotkowski

*Attorney, Agent, or Firm*—Barnes, Kisselle, Raisch, Choate, Whittemore & Hulbert

[57] ABSTRACT

This invention relates to devices which adapt to and attach to ladders and step ladders to enhance the balance and stability of the user and to provide support for equipment, tools and supplies. Supporting means comprising a wide foot plate and supporting means comprising a rigid shaft utensil support constitute the basic elements of the invention. The foot plate support enhances the stability, balance and comfort of the user thereby permitting the user to work for longer periods of time and freeing the users' hands.

The rigid shaft utensil support is inserted through the rung of a ladder to support tools, equipment, supplies, etc., which may be placed thereon or suspended therefrom.

3 Claims, 2 Drawing Sheets

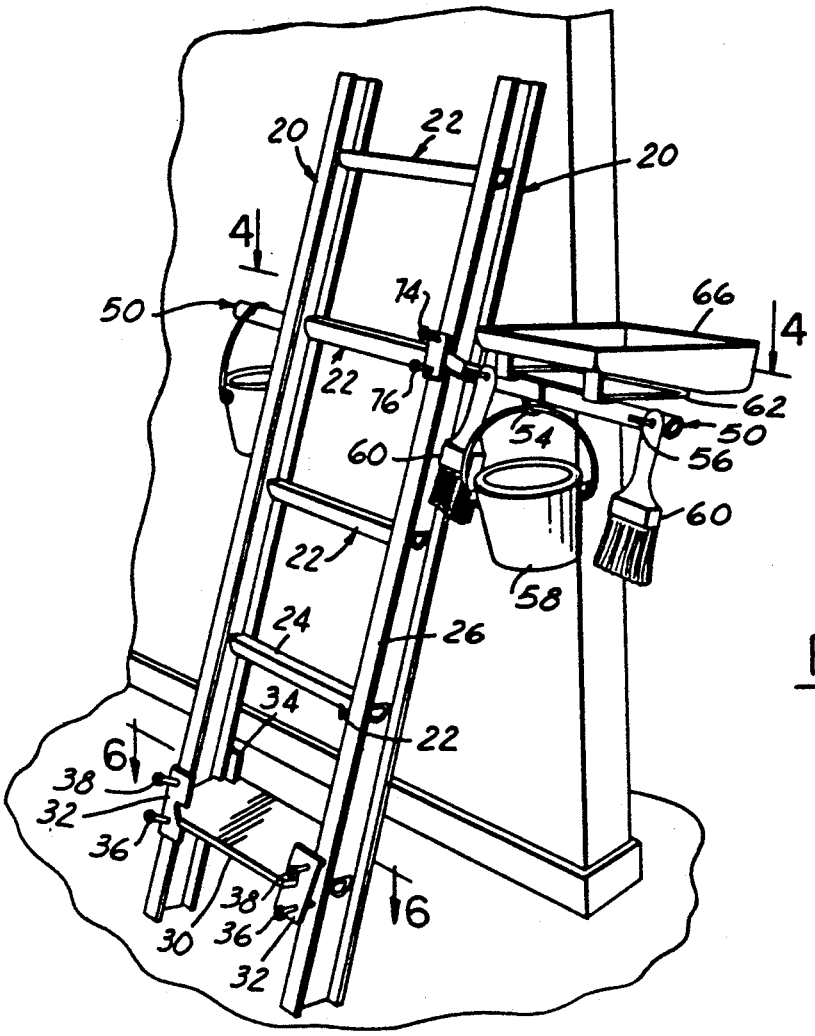
FIG. 1
FIG. 2
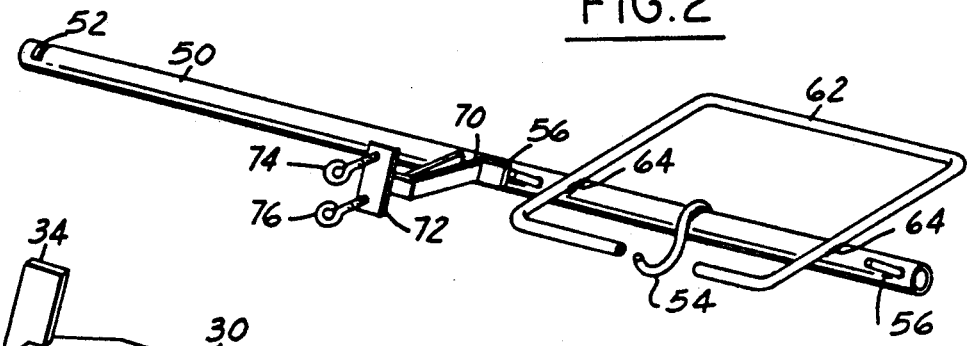
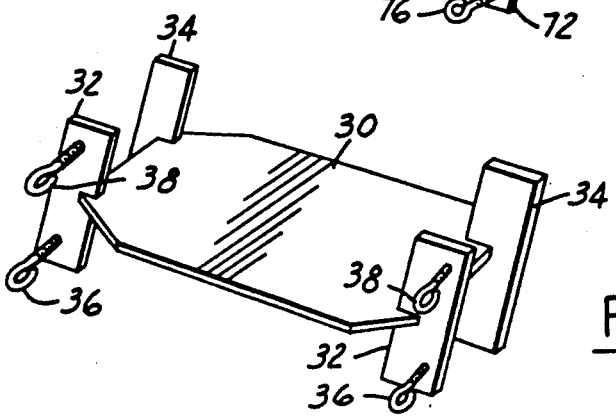
FIG. 3

LADDER ACCESSORIES

FIELD OF THE INVENTION

This invention relates to devices which adapt to and attach to ladders and step ladders to enhance the balance and stability of the user and to provide support for equipment, tools and supplies.

BACKGROUND AND FEATURES OF THE INVENTION

Ladders are simple devices used for climbing up or down and consist essentially of: (1) two long side pieces or spaced uprights with outer and inner edge surfaces and (2) cross pieces or horizontal rungs between the spaced uprights. Step ladders have a hinged support for steadying the structure and are often equipped with a flat receptacle which is attached to the ladder and assumes a horizontal position when the ladder is in use.

Although ladders and step ladders are common and in widespread use, it is difficult to perform various activities since the user only has access to the attached receptacle in the case of the step ladder; and has no means to support tools, brushes, supplies and the like when using a ladder.

In addition, both ladders and step ladders have cross pieces which are too narrow to adequately support and balance the user, particularly during prolonged periods of use. Narrow rungs, particularly on new aluminum ladders, hit the arch of the foot and are uncomfortable for long periods of work. The narrow rungs also diminish the balance of the user; therefore, the user must prop his/her knee against an adjacent rung for support, or hold on to the upright. It is readily apparent that enhanced balance is important to users who typically assume precarious positions on a ladder or step ladder.

In view of these limitations, scaffolding has been used to support supplies, tools and equipment, and to provide balance and support for the user. Scaffolding is expensive and it is inconvenient. It is apparent that cumbersome scaffolding takes considerable time and effort to assemble and to move from place to place as a typical job progresses.

It is the object of the present invention to provide accessories which adapt to and attach to existing ladders and step ladders to facilitate access to tools, supplies, etc., and to balance and stabilize the user. More particularly, the invention includes the following major accessories:

(1) support means comprising a wide foot plate to enhance the stability and balance of the user, so the user need not support himself against a rung or by holding on to an upright. Therefore, both hands are free and the user is able to work comfortably for long periods of time, (2) support means comprising a rigid shaft utensil support inserted into a rung to support tools, equipment, supplies, etc., which may be placed thereon or suspended therefrom.

The support means comprising the foot plate and rigid shaft are both adjustable to adapt to the various rungs in accordance with the requirements of the user. Both support means are also adjustable to a variety of angles thus freeing the user from the practice of conforming to the angle of the ladder itself. In summary, the support means and related components described herein, when used with a ladder, provide a system which adapts to user, whereas current ladders force the user to conform to the limitations of the ladder.

Briefly stated, the accessories generally include the following basic components:

(1) A support means to rest on a rung and a clamp to attach said support means to the edge of the upright and adjustable screws to contact the upright so as to adjust the horizontal orientation of said support means, and reaction means to provide resistance as the adjustable screws are tightened.

(2) Support means as described above comprising a wide foot plate to rest on a ladder rung and reaction means consisting of opposed clamp plates to contact the outer edges of an upright.

(3) Support means as described above comprising a rigid shaft passing through a rung to support utensils and reaction means contacting the interior of the rung.

Other objects and features of the invention will be apparent in the following specification and claims in which the invention is described together with details to enable persons skilled in the art to practice the invention, all in connection with the best mode presently contemplated for the invention.

BRIEF DESCRIPTION OF THE DRAWINGS

DRAWINGS accompany the disclosure, and the various views thereof may be briefly described as:

FIG. 1 is an illustration showing a ladder having support means comprising the wide foot plate and support means comprising the rigid shaft utensil support.

FIG. 2 shows the support means comprising the rigid shaft utensil support.

FIG. 3 shows the support means comprising the wide foot plate support.

DETAILED DESCRIPTION OF THE INVENTION AND THE MANNER AND PROCESS OF USING IT

Figure 4:
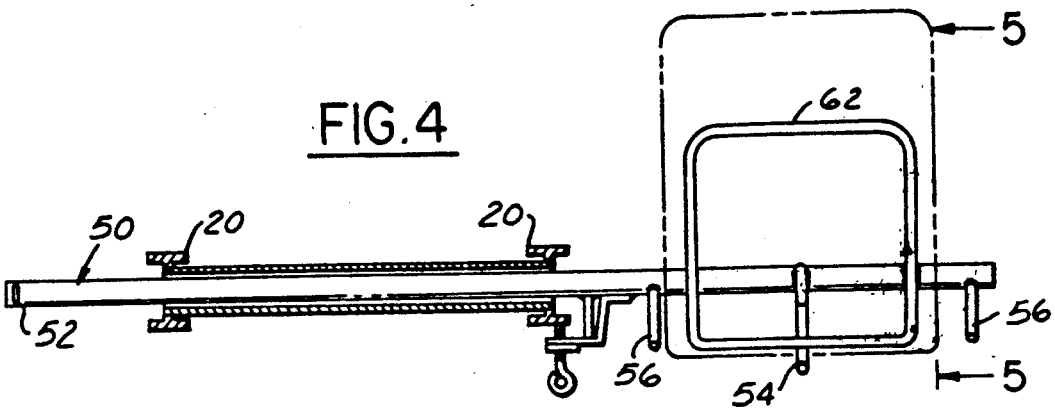
FIG. 4 is a top view taken along the line 4—4 of FIG. 1.
Figure 5:
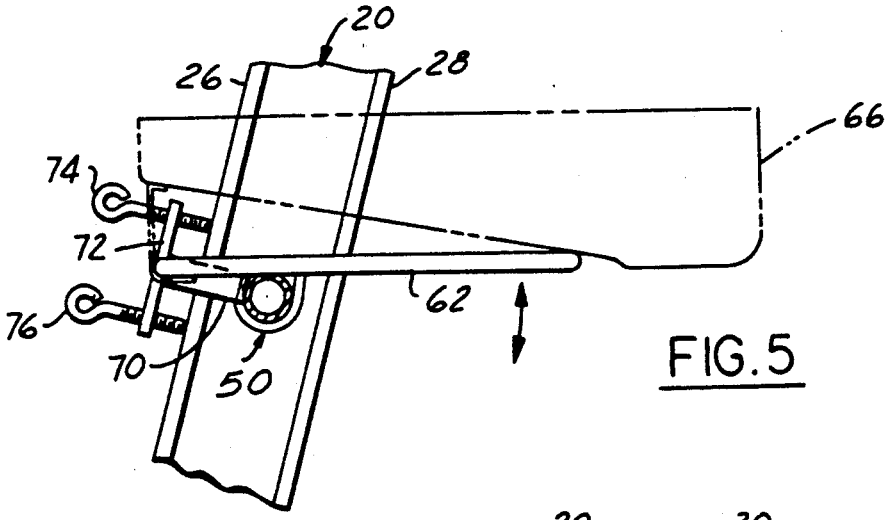
FIG. 5 is a side view taken along the line 5—5 of FIG. 4 and detailing: the clamp, adjustable screws, reaction means and the arc of adjustment.
Figure 6:
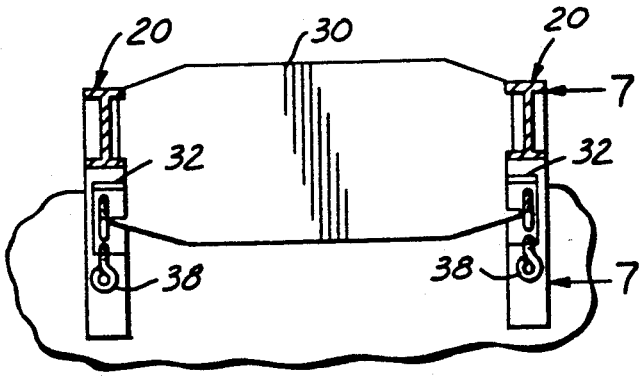
FIG. 6 is a top view taken along the line 6—6 of FIG. 1.

With reference to FIG. 1, a metal ladder, usually formed of aluminum for lightness, is shown having upright or side runs 20 formed with an I-beam shape which provides elongate recesses on the outside and inside and flat surfaces front and back. In present day manufacture of these metal ladders the rungs 22 are tubular with a narrow flat top surface 24. The ends of the rungs are secured in the web of the I-beam sides by suitable riveting or welding. The ladder uprights have front sides 26 and rear sides 28.

A first accessory for use on the ladder is a wide step support plate 30 provided with spaced clamping plates 32 and 34 at each end angled to the plane of the plate 30 (FIG. 3) to adapt partially to the angle of inclination of the ladder. The back plates 34 bear against the rear side 28 of the ladder uprights. The front plate 32 has vertically spaced adjustment screws 36 and 38 which will bear against the front side 26 of the ladder upright.

Figure 7:
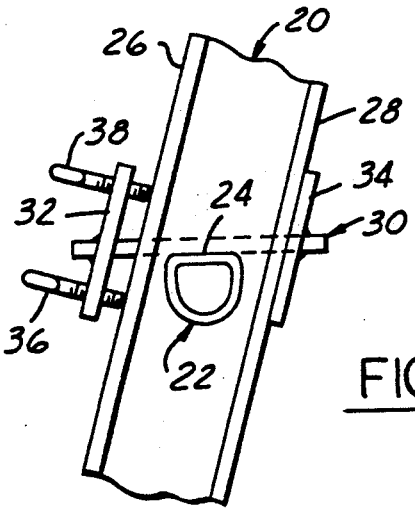
FIG. 7 is a side view taken along the line 7—7 of FIG. 6 and detailing: the clamp, adjustable screws and reaction means.

The plate 30 is preferably 5" or 6" wide and has a length with ends which can insert a short distance into the inner recess of the side uprights. The manipulation of the screws 36, 38 can adjust the level of the step plate 30 so that it can be leveled in response to the angle of inclination of the ladder which may vary with particular uses. Tightening the screws 36, 38 causes the back plates 34 to serve as reaction members drawing tight against the back of the upright. As shown by the dotted line in FIG. 7, the plate 30 rests on the top of a rung 22 and receives primary support from the rung.

In FIGS. 1, 2, 4 and 5, a second ladder accessory is illustrated which also is adapted to the construction of present day metal ladders. A metal shaft 50 in the form of a hollow tube is dimensioned to pass through the opening in the hollow rungs 22. As shown in FIG. 2, one end of the shaft is unencumbered but may have a notch 52 to receive the bail of a paint can. This permits the shaft to pass through the rung. The exposed end of the shaft at the right has a hook and projections 54 and 56 for supporting a paint pail 58 and a paint brushes 60, respectively. An open rectangular frame 62 is welded on the shaft at 64 to be used as an additional support for a paint roller pan 66.

A bracket 70 secured to the shaft carries a vertical plate 72 and vertically spaced screws 74, 76 are positioned to bear against the front face 26 of a ladder upright. These screws can be adjusted to determine the angle of the frame 62. As paint is used up in the pan 66, the angle could be changed to move the paint further into the deeper section. Tightening the screws 74, 76 brings the shaft into a reaction bearing surface on the forward side of the rung in which it is located.

With the accessories described it will be seen that a workman can support himself on the foot plate 30 at any desired level with comfortable stability. His hands can be free then to perform such work as is desired with ready access to the supplies in shaft 50 whether it be paint, nails, hammers, putty knives, and so forth as the case may be.

What is claimed is:

1. An accessory for use on ladders having spaced uprights with outer and inner edge surfaces and cross rungs therebetween which comprises:

(a) a support means to rest on a portion of a selected horizontal rung to receive support from said rung, (b) first means to provide a clamp for said support means including a first clamp plate on said support means to overlie an edge surface of each said upright, (c) vertically spaced adjustable screws on said plate to contact an outer surface of an edge of an upright to adjust the horizontal orientation of said support means with respect to the angle of inclination of said ladder, (d) each said support means including a reaction means to bear on a portion of said ladder to provide a clamping resistance to the tightening of said adjustment screws, and (e) rungs which are hollow and open at each end, and said support means comprising a rigid shaft passing through a selected rung and extending to beyond at least one side of said upright to support utensils, and said reaction means comprising the interior of said selected rung.

2. An accessory as defined in claim 1 in which a paint roller tray is mounted on said shaft to be disposed horizontally in relation to the angle of inclination of said ladder.

3. An accessory for use on a metal ladder having flanged uprights and hollow rungs mounted between said uprights open at each end which comprises:

(a) a stable, relatively wide, foot plate to mount on a rung between uprights, (b) spaced relatively vertical clamp plates separate from one another and secured at each end of said foot plate, one to contact the rear side of an upright and one to overlie the front face of an upright, (c) vertically spaced screw means on one of said clamp plates to clamp the upright at various angles to level said foot plate with respect to the angle of inclination of a ladder, and an accessory support for tools and buckets disposed on said ladder comprising:

(d) a rigid shaft passing through and supported in said rung which is hollow, (e) means on an extending end of said shaft for supporting tools, paint brushes, paint buckets and the like, (f) a bracket supported plate on said extending end of said shaft having a portion overlying a face of an upright, and (g) vertically spaced screws on said bracket plate to contact an upright and adjust the orientation of a ladder.

* * * * *